US005564152A

United States Patent [19]

Jeannet et al.

[11] Patent Number: 5,564,152

[45] Date of Patent: Oct. 15, 1996

[54] TOOTHBRUSH

[75] Inventors: Roland Jeannet, Dusseldorf, Germany; Robert Leutwyler, Boppelsen; Werner Leutwyler, Zurich, both of Switzerland

[73] Assignee: Johnson & Johnson Consumer Products, Inc., Skillman, N.J.

[21] Appl. No.: 588,295

[22] Filed: Jan. 18, 1996

Related U.S. Application Data

[63] Continuation of Ser. No. 380,928, Jan. 3, 1995, abandoned, which is a continuation of Ser. No. 195,979, Feb. 14, 1994, abandoned, which is a continuation of Ser. No. 971,368, Nov. 4, 1992, abandoned.

[30] Foreign Application Priority Data

Nov. 6, 1991 [DE] Germany ..... 41 36 537.2

[51] Int. Cl.[6] ..... A46B 9/04

[52] U.S. Cl. ..... 15/167.1; 15/145; 15/176.2; 403/326; 403/327

[58] Field of Search ..... 15/145, 144.1, 15/167.1, 172, 176.1–176.6; 403/326, 327, 315, 316, 118

[56] References Cited

U.S. PATENT DOCUMENTS

| | | | |
|---|---|---|---|
| 1,859,129 | 5/1932 | Costenbader | 15/172 |
| 2,679,657 | 6/1954 | Krueger | 15/172 |
| 2,749,567 | 6/1956 | Krueger | 15/172 |

FOREIGN PATENT DOCUMENTS

| | | | |
|---|---|---|---|
| 287022 | 3/1928 | United Kingdom | 15/176.2 |

*Primary Examiner*—Mark Spisich

[57] ABSTRACT

The invention relates to a toothbrush (20), the brush head (22) of which can be removed from a brush handle (24). A threaded pin (26) can be moved to a limited extent out of the brush handle (24), counter to the action of a prestressing spring (32), when the brush head (22) is screwed onto the pin, until a stop catch (36) of the brush head (22) engages in a recess (38) of the brush handle (24) and locks the brush head in the rotational direction, while the prestressing spring (32) holds the brush head (22) under prestress against the brush handle (24). A firm connection can thus be established simply and rapidly between the brush handle and the brush head, irrespective of the shape of these parts.

15 Claims, 4 Drawing Sheets

FIG. 3
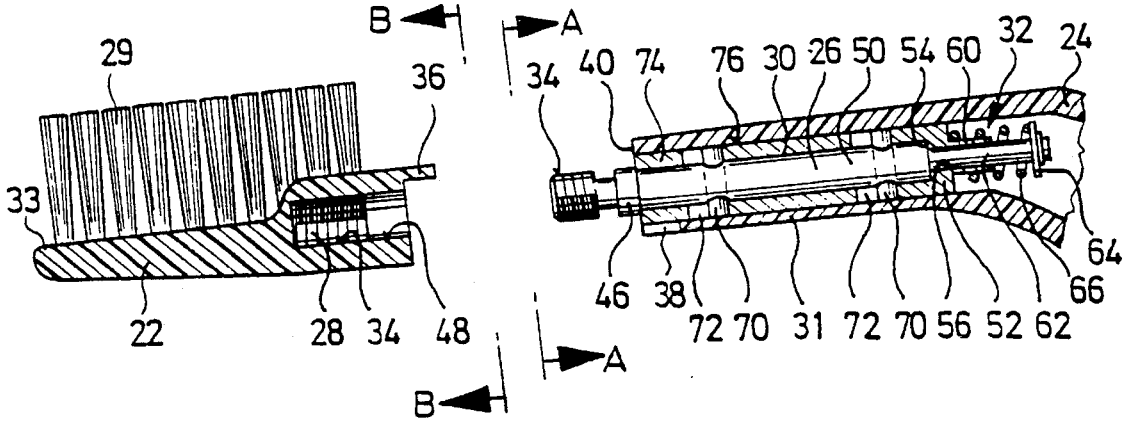
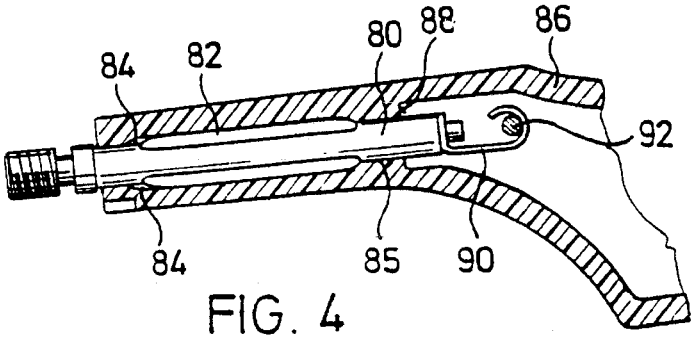
FIG. 4
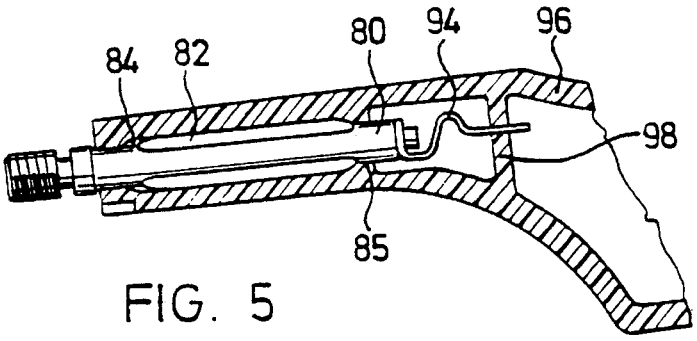
FIG. 5

TOOTHBRUSH

CROSS-REFERENCE TO RELATED APPLICATIONS

This is a continuation of application Ser. No. 380,928, filed Jan. 31, 1995, abandoned, which in turn is a continuation of application Ser. No. 195,979, filed Feb. 14, 1994, abandoned, which in turn is a continuation of application Ser. No. 971,368, filed Nov. 4, 1992, abandoned, and incorporates by reference all subject matter set forth in all parent applications.

BACKGROUND OF THE INVENTION

1. Field of the Invention

The invention relates to a toothbrush, the brush head of which is removably secured on the brush handle, it being possible to screw a threaded pin protruding from the front end of the brush handle, that end which faces the brush head, in a manner fixed against twisting into a threaded hole in the rear end of the brush head, that end which faces the brush handle.

2. Description of the Prior Art

A toothbrush of this generic type is known from German Utility Model 7,600,205. In this toothbrush, a fixing screw, which can be screwed into a threaded bore in the brush head, is arranged on a spindle which extends through a longitudinal bore in the brush handle and is actuated by means of a rotary knob situated at the end of the brush handle. The angular position of the brush handle relative to the brush head is secured by guide pins on the brush handle which engage in corresponding guide bores in the brush head. In the assembly of the toothbrush, the brush head is first of all placed on the guide pins of the brush handle, then moved along in the axial direction towards the brush handle on the guide pins and, finally, tightened by actuating the rotary knob at the end of the brush handle.

SUMMARY OF THE INVENTION

The object on which the invention is based is to configure the toothbrush of the abovementioned known generic type in such a way that the brush head can be secured on the brush handle rapidly, reliably and in a manner secure against release of the connection by children, whatever the shape of the brush handle and brush head, with as large as possible a saving of material for the replaceable brush head.

The invention solves this object by virtue of the fact that the threaded pin is mounted in an axial sliding bearing in the front end of the brush handle in such a way that it can be moved to a limited extent axially out of the brush handle, counter to the force of a prestressing device, but cannot be rotated, and is provided at its front end with a thread which can be screwed into the threaded hole of the brush head, a stop catch projecting axially from the rear end of the brush head, to which catch there corresponds an axial recess in the front end of the brush handle, with the result that, when the brush head is screwed onto the threaded pin, the brush head is supported on the front end of the brush handle by means of the stop catch and the threaded pin can be pulled out counter to the action of the prestressing device until the stop catch engages in the recess in the brush handle.

It is especially advantageous if the front end of the brush handle, which accommodates the sliding bearing, is formed by that end of a brush-handle neck which adjoins the brush head, and the threaded hole is integrated into a bristle bed which accommodates the bristles of the brush head. By virtue of this close arrangement of the threaded connection on the brush head, as great as possible a saving of material can be achieved for the disposable brush head.

In this arrangement, a centring ring can be arranged at an axial distance from the thread, at the front end of the threaded pin, and a smooth cylindrical portion of the threaded hole, the said portion being situated in the region of the mouth of the threaded hole in the brush head, can serve to receive the centring ring. It may furthermore be expedient if the diameters of the thread and of the centring ring of the threaded pin are larger than the shank of the threaded pin, which is displaceably mounted in the brush handle. The thread and the centring ring can here have the same diameter. In this way, a high strength of the connection between the brush head and the brush handle is achieved.

The axial sliding bearing for the threaded pin in the brush handle can be bounded by a transverse wall which serves as a stop for at least one stop element on the threaded pin, the rear end of which passes axially through a bore in the transverse wall and which is connected to one part of the prestressing device, the other part of which is secured in the brush handle. The prestressing spring can be designed as a compression spring or, alternatively, as a tension spring. A child-proof connection between the brush handle and the brush head can be achieved by selection of a suitable spring characteristic.

The exclusively axial guidance of the threaded pin in the sliding bearing of the brush handle can be provided by radial projections on the threaded pin which engage in longitudinally directed recesses of the sliding bearing, allowing only axial mobility.

An angle of rotation of 180° is sufficient for securing the brush head on the brush handle by means of a multi-start thread.

The sliding bearing in the brush handle for the threaded pin and the threaded hole in the brush head are preferably composed of the same material of which the brush handle and the brush head are respectively composed, and are produced integrally with these. On the other hand, the sliding bearing and the threaded hole can also be formed by inserted sleeves which are secured in corresponding axial bores of the brush handle and brush head respectively.

BRIEF DESCRIPTION OF THE DRAWINGS

The invention is explained in greater detail below with reference to the schematic drawing of several illustrative embodiments, in which:

FIG. 3 shows the toothbrush in accordance with FIG. 2 with the brush head removed and a sliding bearing sleeve for a threaded pin in partially broken-away representation, FIGS. 4 and 5 show two different modified embodiments of the threaded pin with a prestressing device in a section taken perpendicularly through the longitudinal centre line and in partially broken-away representation.

DESCRIPTION OF THE PREFERRED EMBODIMENTS

Figure 6A:
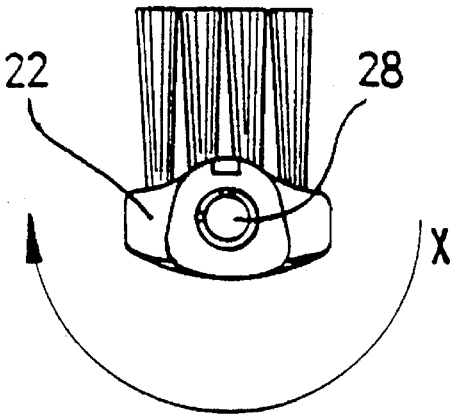
FIG. 6A and FIG. 6B show a view of the rear end of the brush head in accordance with B—B in FIG. 3 in an insertion position and in the operating position.
Figure 6B:
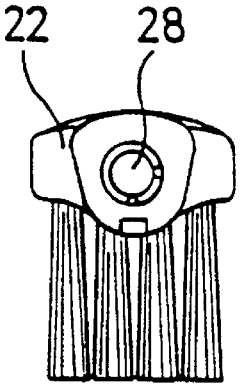
Figure 7A:
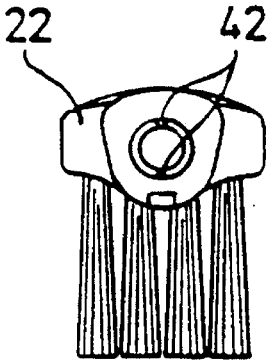
FIG. 7A and FIG. 7B show a view of the rear end of the brush head similar to that in FIG. 6B, with a two-start or three-start thread.
Figure 7B:
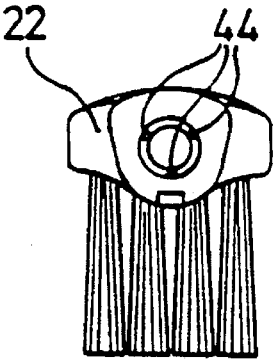

The drawings illustrate a toothbrush 20, the brush head 22 of which is removably secured on the brush handle 24. In accordance with FIGS. 2 and 3, a threaded pin 26, preferably composed of plastic, which projects from the front end of the brush handle 24, that end which faces the brush head 22, can be screwed into an integral threaded hole 28 which is arranged in a reinforced part of a bristle bed (33), the said part accommodating the bristles (29) of the brush head (22), in the rear end of the brush head 22, that end which faces the brush handle 24. According to the present invention, the threaded pin 26 is mounted in an axial sliding bearing 30 in the front end of a neck 31 of the brush handle 24 in such a way that it can be moved to a limited extent axially out of the front end of the brush handle 24, counter to the force of a prestressing device 32, but cannot be rotated. At its front end, the threaded pin 26 is provided with a thread 34 which can be screwed into the threaded hole 28 of the brush head 22. Projecting axially from the rear end of the brush head 22, on the side of the bristles 29, is a stop catch 36, to which there corresponds an axial recess 38 in the front end of the brush handle 24. When the brush head 22 is screwed on, the stop catch 36 comes to rest against the end face 40 of the front end of the brush handle 24 after a small angle of rotation. If the screw-on movement of the brush head 22 is continued or a corresponding screw-in movement of the brush handle 24 into the brush head 22 is performed, the threaded pin 26 is pulled out of the front end of the brush handle 24 counter to a prestressing device 32 in accordance with the thread pitch, until the stop catch 36 engages in the recess 38 at the front end of the brush handle 24 and assumes its non-rotatable working position in which it is braced axially in relation to the brush handle 24. If the brush head 22 is to be replaced by another, new brush head, the brush head need only be pulled axially away from the end face 40 of the front end of the brush handle 24 by the length of the stop catch 36, counter to the force of the prestressing device 32, in order to unscrew the brush handle 24 from the thread 34 in the opposite direction of rotation. FIG. 6A depicts the starting position of the brush head 22 for its mounting on the brush handle 24 as well as an arrow X extending over 180°, the said arrow indicating that a half rotation of the brush head 22 for its mounting on the brush handle 24 is sufficient to enable it to assume the working position in accordance with FIG. 6B. As FIG. 7A and FIG. 7B show, a two-start thread 42 or a three-start thread 44 are to be preferred for connecting the brush head 22 and the brush handle 24. The thread 34 and the centring ring 46 expediently have the same diameter.

Figure 1:
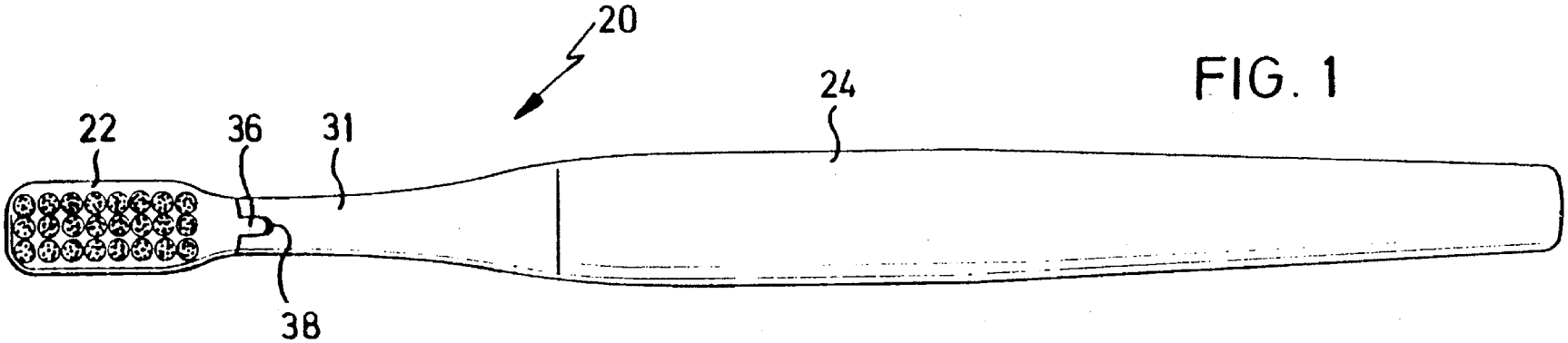
FIG. 1 shows a bottom view of a toothbrush with mounted brush head.
Figure 2:
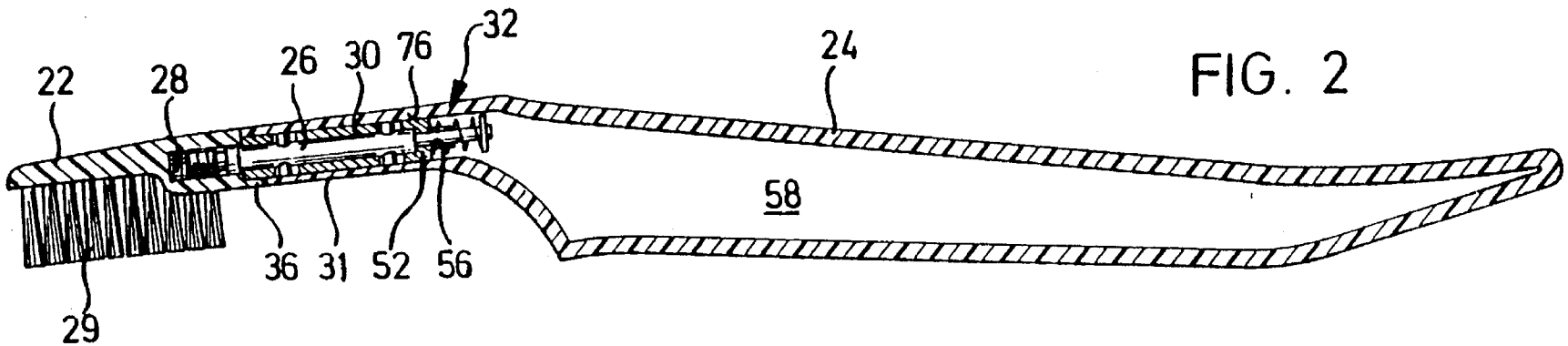
FIG. 2 shows the toothbrush according to FIG. 1 in a partially sectioned view along the longitudinal centre line.

From FIGS. 2 and 3, it can be seen that a centring ring 46 is arranged at the front end of the threaded pin 26, at an axial distance from the thread 34. Provided in the region of the mouth of the threaded hole 28 in the brush head 22 is a smooth cylindrical portion 48 of the threaded hole 28 for receiving the centring ring 46. The diameters of the thread 34 and of the centring ring 46 of the threaded pin 26 are larger than the shank 50 of the threaded pin, which is displaceably mounted in the brush handle 24. The thread 34 and the centring ring 34 expediently have the same diameter.

As FIGS. 2 and 3 furthermore show, the sliding bearing 30 in the brush handle 24 for the threaded pin 26 is bounded by a transverse wall 52 which serves as a stop for an annular shoulder 54 on the inner end of the threaded pin 26. The transverse wall 52 is provided with an axial bore 56, which has a smaller diameter than the shank 50 of the threaded pin 26 and continues in a guide sleeve 60 towards the inner cavity 58 of the brush handle 24. A guide rod 62 extends through this bore 56 in the transverse wall 52 and through the guide sleeve 60 from that end of the shank 50 of the threaded pin 26 which forms the annular shoulder 54, a supporting disc 64 being secured on the outer end of this guide rod 62. The prestressing device 32, which, in the illustrative embodiment of FIGS. 2 and 3, is designed as a helical compression spring, is guided on the guide sleeve 60 of the transverse wall 52 and is supported by its two ends between the transverse wall 52 and the supporting disc 68, with the result that the threaded pin 26 is continuously prestressed in the direction of the transverse wall 52.

Figure 8:
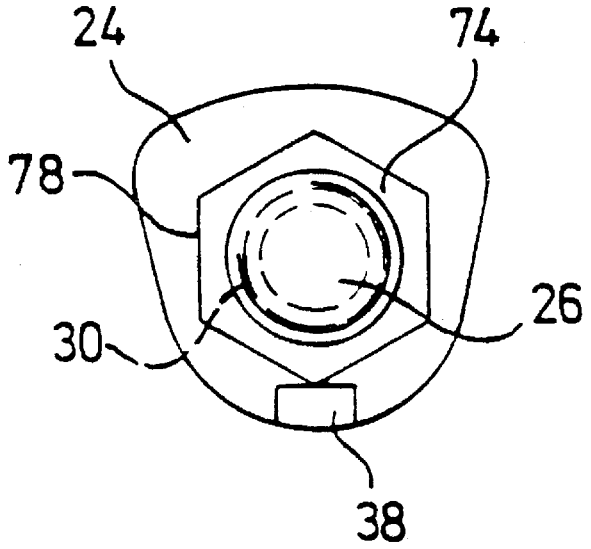
FIG. 8 shows a view A—A in FIG. 3, with an inserted sleeve for the threaded pin
Figure 9:
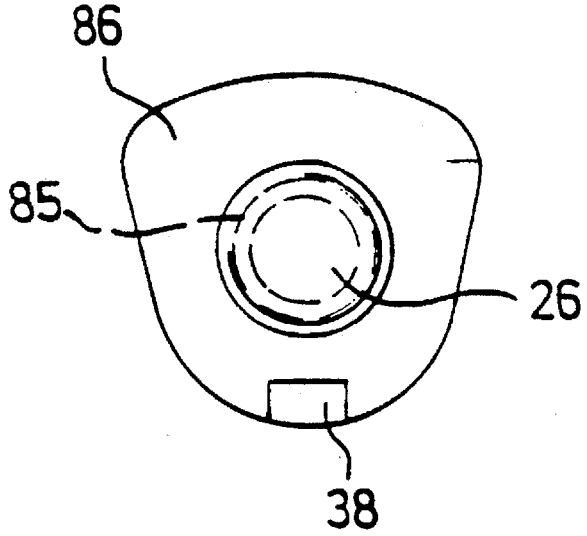
FIG. 9 shows a view similar to A—A in FIG. 3 but with a sliding bearing for the threaded pin, the said sliding bearing being integrated into the brush handle.

The shank 50 of the threaded pin 26 is provided with radial projections which engage in longitudinally directed recesses of the sliding bearing 30, allowing only axial mobility. According to FIGS. 2 and 3, the radial projections of the shank 50 comprise two transverse pins 70 arranged at an axial distance from one another, which project radially from the shank 50 of the threaded pin 26 and engage in elongated slots 72 which only permit axial displacement and not rotation of the threaded pin 26. According to the illustrative embodiment in FIGS. 2 and 3, the diametrically opposite elongated slots 72 for the transverse pins 70 are provided in an inserted sleeve 74 which is inserted into a cylindrical bore 76 in the front end of the brush handle 24 and is arranged therein in a manner which prevents axial displacement and fixed in terms of rotation. The inserted sleeve 74 expediently has a polygonal external profile 78, as FIG. 8 shows.

According to another embodiment in FIGS. 4 and 5, a threaded pin 80 is provided with longitudinal ribs 82 which are distributed at angular intervals over the circumference and engage with limited longitudinal displaceability in corresponding longitudinal grooves 84 of a sliding bearing 85 in the brush handle 86, the said longitudinal grooves 84 being delimited at the ends and being moulded directly in the material of a brush handle 86, integrally with the latter. In this case, the threaded pin 80 passes with the same diameter through the front end and a transverse wall 88 of the brush handle 86, which are likewise an integral part of the brush handle 86. Secured on the inner end of the threaded pin 80, which protrudes from the transverse wall 88, is one end of a leaf spring 90 which forms the prestressing device, its other, curved end being placed around a transverse peg 92 in the brush handle 86.

FIG. 5 shows a similar embodiment to that in FIG. 4, identical parts thus being provided with identical reference numerals to those in FIG. 4. As in FIG. 4, a single leaf spring 94 is secured on the inner end of the threaded pin 80 but is then oriented in an S shape towards the interior of a brush handle 96. The other end of the leaf spring 94, which extends axially to the threaded pin 80, is fixed in a transverse wall 98 of the brush handle 86.

The various brush handle embodiments described above comprise hollow handle longitudinal halves produced by injection moulding, into which, as has been described, either the inserted sleeves for the sliding bearing of the threaded pin, the latter likewise preferably being composed completely of plastic, are inserted or in which the sliding bearings are integrally moulded from the plastic material of the brush handle halves by injection, before the associated halves of the thread are firmly welded together, e.g. by high-frequency welding. It should also be understood that it is also possible, when the brush head is produced by injection moulding of plastics, for the threaded hole with the associated thread to be integrally moulded or, alternatively, for the threaded hole likewise to be formed by a sleeve around which the brush head is moulded or which is inserted into a corresponding bore in the brush head after the moulding of the brush head. The hollow configuration of the brush handle saves material and reduces the weight of the said handle, making possible more sensitive cleaning of the teeth with the toothbrush. If required, the threaded pin can be arranged in the brush head and the threaded hole in the brush handle, although the embodiments described above are generally to be preferred.

In all the cases described, the strength of the spring can be designed so that it is impossible for small children to separate the brush head from the brush handle. The prestressing spring can also be manufactured from plastic.

List of reference numerals

20 Toothbrush
22 Brush head
24 Brush handle
26 Threaded pin
28 Threaded hole
29 Bristles
30 Sliding bearing
31 Handle neck
32 Prestressing device
33 Bristle bed
34 Thread
36 Stop catch
38 Recess
40 End face
42 Two-start thread
44 Three-start thread
46 Centring ring
48 Smooth cylindrical portion
50 Shank
52 Transverse wall
54 Annular shoulder
56 Axial bore
58 Cavity
60 Guide sleeve
62 Guide rod
64 Supporting disc
66 Helical compression spring
70 Transverse pin
72 Elongated slots
74 Inserted sleeve
76 Cylindrical bore
78 External profile
80 Threaded pin
82 Longitudinal ribs
84 Longitudinal grooves
85 Sliding bearing
86 Brush handle
88 Transverse wall
90 Leaf spring
92 Transverse peg
94 Leaf spring
96 Brush handle
98 Transverse wall

We claim:

1. A toothbrush comprising:

a handle including a first end having a recess formed therein, a second end, a bearing disposed in said first end and a pin slidably supported within said bearing, said pin comprising a first end, a shank portion and a second end, said pin defining a longitudinal axis whereby said pin is supported for axial movement in said bearing substantially parallel to said longitudinal axis, said first end of said pin including a threaded portion projecting from said first end of said handle and a centering ring spaced from said threaded portion, said handle further comprising means for preventing rotation of said pin and prestressing means connected to said second end of said pin for urging said pin in a direction toward said second end of said handle and for permitting limited axial movement of said pin out of said first end of said handle; and a brush head including a threaded hole operable to threadably engage said threaded portion of said first end of said pin, said threaded hole including a cylindrical portion operable to receive said centering ring, said brush head further comprising a stop catch projecting from said brush head operable to engage said recess in said first end of said handle, whereby, as said brush head is screwed onto said handle, said stop catch contacts said first end of said handle and said pin is pulled out of said handle counter of the action of said prestressing means until said stop catch engages said recess.

2. The toothbrush of claim 1 wherein the diameters of said threaded portion and said centering ring are greater than said shank portion of said pin.

3. The toothbrush of claim 2 wherein said threaded portion and said centering ring have the same diameter.

4. The toothbrush of claim 3 wherein said prestressing means comprises a tension spring and wherein a first end of said tension spring is connected to said second end of said pin and a second end of said tension spring is anchored in said brush handle.

5. A toothbrush comprising:

a handle including a first end having a recess formed therein, a second end, a bearing disposed in said first end and bounded by a transverse wall having a bore therethrough, and a pin slidably supported within said bearing, said pin comprising a first end, a shank portion and a second end, said pin defining a longitudinal axis whereby said pin is supported for axial movement in said bearing substantially parallel to said longitudinal axis, said first end of said pin including a threaded portion projecting from said first end of said handle, said pin further comprising at least one stop element whereby said transverse wall serves as a stop for said at least one stop element, said second end of said pin extending through said bore in said transverse wall and carrying a supporting disc, said handle further comprising means for preventing rotation of said pin and prestressing means including a helical compression spring disposed between said transverse wall and supporting disc for urging said pin in a direction toward said second end of said handle and for permitting limited axial movement of said pin out of said first end of said handle; and a brush head including a threaded hole operable to threadably engage said threaded portion of said first end of said pin, and a stop catch projecting from said brush head operable to engage said recess in said first end of said handle, whereby, as said brush head is screwed onto said handle, said stop catch contacts said first end of said handle and said pin is pulled out of said handle counter of the action of said prestressing means until said stop catch engages said recess.

6. A toothbrush comprising:

a handle including a first end having a recess formed therein, a second end, a bearing disposed in said first end and a pin slidably supported within said bearing, said pin comprising a first end, a shank portion and a second end, said pin defining a longitudinal axis whereby said pin is supported for axial movement in said bearing substantially parallel to said longitudinal axis, said first end of said pin including a threaded portion projecting from said first end of said handle, said handle further comprising means for preventing rotation of said pin, said means for preventing rotation of said pin comprising longitudinally directed, closed-ended recesses provided in said bearing and a plurality of spaced apart, radially projecting transverse pins provided on said shank portion that engage said recesses, said handle further comprising prestressing means connected to said second end of said pin for urging said pin in a direction toward said second end of said handle and for permitting limited axial movement of said pin out of said first end of said handle; and a brush head including a threaded hole operable to threadably engage said threaded portion of said first end of said pin, and a stop catch projecting from said brush head operable to engage said recess in said first end of said handle, whereby, as said brush head is screwed onto said handle, said stop catch contacts said first end of said handle and said pin is pulled out of said handle counter of the action of said prestressing means until said stop catch engages said recess.

7. A toothbrush comprising:

a handle including a first end having a recess formed therein, a second end, a bearing disposed in said first end and a pin slidably supported within said bearing, said pin comprising a first end, a shank portion and a second end, said pin defining a longitudinal axis whereby said pin is supported for axial movement in said bearing substantially parallel to said longitudinal axis, said first end of said pin including a threaded portion projecting from said first end of said handle, said handle further comprising means for preventing rotation of said pin, said means for preventing rotation of said pin comprising longitudinally directed grooves provided in said bearing and a plurality of longitudinally directed ribs provided on said shank portion that engage said grooves, said handle further comprising prestressing means connected to said second end of said pin for urging said pin in a direction toward said second end of said handle and for permitting limited axial movement of said pin out of said first end of said handle; and a brush head including a threaded hole operable to threadably engage said threaded portion of said first end of said pin, and a stop catch projecting from said brush head operable to engage said recess in said first end of said handle, whereby, as said brush head is screwed onto said handle, said stop catch contacts said first end of said handle and said pin is pulled out of said handle counter of the action of said prestressing means until said stop catch engages said recess.

8. A toothbrush comprising:

a handle including a first end having a recess formed therein, a second end, a bearing disposed in said first end and a pin slidably supported within said bearing, said pin comprising a first end, a shank portion and a second end, said pin defining a longitudinal axis whereby said pin is supported for axial movement in said bearing substantially parallel to said longitudinal axis, said first end of said pin including a threaded portion projecting from said first end of said handle, said handle further comprising means for preventing rotation of said pin and prestressing means connected to said second end of said pin for urging said pin in a direction toward said second end of said handle and for permitting limited axial movement of said pin out of said first end of said handle; and a brush head defining a longitudinal direction, said brush head having a first side and bristles projecting from said first side substantially transverse to said longitudinal direction, said brush head further including a threaded hole extending substantially in said longitudinal direction and operable to threadably engage said threaded portion of said first end of said pin, and a tongue shaped stop catch projecting from an end of said brush head and extending substantially in said longitudinal direction and operable to engage said recess in said first end of said handle, whereby, as said brush head is screwed onto said handle, said stop catch contacts said first end of said handle and said pin is pulled out of said handle counter of the action of said prestressing means until said stop catch engages said recess.

9. A toothbrush comprising:

a handle including a first end having a recess formed therein, a second end, a substantially cylindrical bore provided in said first end, a bearing formed as a sleeve inserted in said substantially cylindrical bore, and a pin slidably supported within said bearing, said pin comprising a first end, a shank portion and a second end, said pin defining a longitudinal axis whereby said pin is supported for axial movement in said bearing substantially parallel to said longitudinal axis, said first end of said pin including a threaded portion projecting from said first end of said handle, said handle further comprising means for preventing rotation of said pin and prestressing means connected to said second end of said pin for urging said pin in a direction toward said second end of said handle and for permitting limited axial movement of said pin out of said first end of said handle; and a brush head including a threaded hole operable to threadably engage said threaded portion of said first end of said pin, and a stop catch projecting from said brush head operable to engage said recess in said first end of said handle, whereby, as said brush head is screwed onto said handle, said stop catch contacts said first end of said handle and said pin is pulled out of said handle counter of the action of said prestressing means until said stop catch engages said recess.

10. The toothbrush of claim 9 wherein the outer circumference of said sleeve is polygonal in cross-section.

11. A toothbrush comprising:

a handle including a first end having a recess formed therein, a second end, a bearing disposed in said first end and a pin slidably supported within said bearing, said pin comprising a first end, a shank portion and a second end, said pin defining a longitudinal axis whereby said pin is supported for axial movement in said bearing substantially parallel to said longitudinal axis, said first end of said pin including a threaded portion projecting from said first end of said handle, said handle further comprising means for preventing rotation of said pin and prestressing means connected to said second end of said pin for urging said pin in a direction toward said second end of said handle and for permitting limited axial movement of said pin out of said first end of said handle; and a brush head including a threaded hole operable to threadably engage said threaded portion of said first end of said pin, and a stop catch projecting from said brush head operable to engage said recess in said first end of said handle, whereby, as said brush head is screwed onto said handle, said stop catch contacts said first end of said handle and said pin is pulled out of said handle counter of the action of said prestressing means until said stop catch engages said recess.

12. The toothbrush of claim 11 wherein said first end of said brush handle defines a neck portion of said handle, wherein said brush head comprises a bristle bed, and wherein said threaded hole of said brush head is integrated into said bristle bed.

13. The toothbrush of claim 11 wherein said brush head is securable onto said brush handle via a 180° angle of screwing rotation of said brush head.

14. The toothbrush of claim 11 wherein said threaded portion of said pin and said threaded hole of said brush head are provided with cooperating multi-start threading.

15. The toothbrush of claim 11 wherein said bearing is formed of the same material as and molded integrally with said brush handle, and wherein said threaded hole of said brush head is formed of the same material as and molded integrally with said brush head.

* * * * *